United States Patent [19]

Staat

[11] 4,397,169

[45] Aug. 9, 1983

[54] ROLLING MILL

[75] Inventor: Karlhans Staat, Homberg, Fed. Rep. of Germany

[73] Assignee: Kocks Technik GmbH & Company, Hilden, Fed. Rep. of Germany

[21] Appl. No.: 228,742

[22] Filed: Jan. 27, 1981

[30] Foreign Application Priority Data

Apr. 15, 1980 [DE] Fed. Rep. of Germany ..... 3014359

[51] Int. Cl.[3] ..... B21B 37/00

[52] U.S. Cl. ..... 72/10; 72/203; 72/338

[58] Field of Search ..... 83/77, 360, 361, 363; 72/10, 12, 14, 33, 203, 338

[56] References Cited

U.S. PATENT DOCUMENTS 2,958,243 11/1960 Foster ..... 83/363
3,496,745 2/1970 Kocks ..... 72/16
3,538,726 11/1970 Cook ..... 72/203

FOREIGN PATENT DOCUMENTS 1427976 5/1969 Fed. Rep. of Germany .

*Primary Examiner*—Francis S. Husar
*Assistant Examiner*—Jonathan L. Scherer
*Attorney, Agent, or Firm*—Buell, Blenko, Ziesenheim & Beck

[57] ABSTRACT

The amount of materials in a piece of tubular stock is measured before the stock enters a stretch-reducing rolling mill and the mill is so controlled that the finished tube can be cut into lengths without the occurrence of overlengths or underlengths. In the case of a seamless tube, the piece of tubular stock is weighed and the flying means which cut the finished tube are so controlled that the lengths of all the finished pieces lie within prescribed tolerances so that there is no waste, other than the usual cropped ends. In the case of welded tube, the thickness of the strip material from which the tube is made can be welded, and the welded tubular stock can be cut to a suitable length to ensure that no overlengths or underlengths are obtained after the stretch-reducing and cutting of the finished tube into pieces of prescribed length, within tolerance limits.

4 Claims, 2 Drawing Figures

ROLLING MILL

DESCRIPTION

Figure 1:
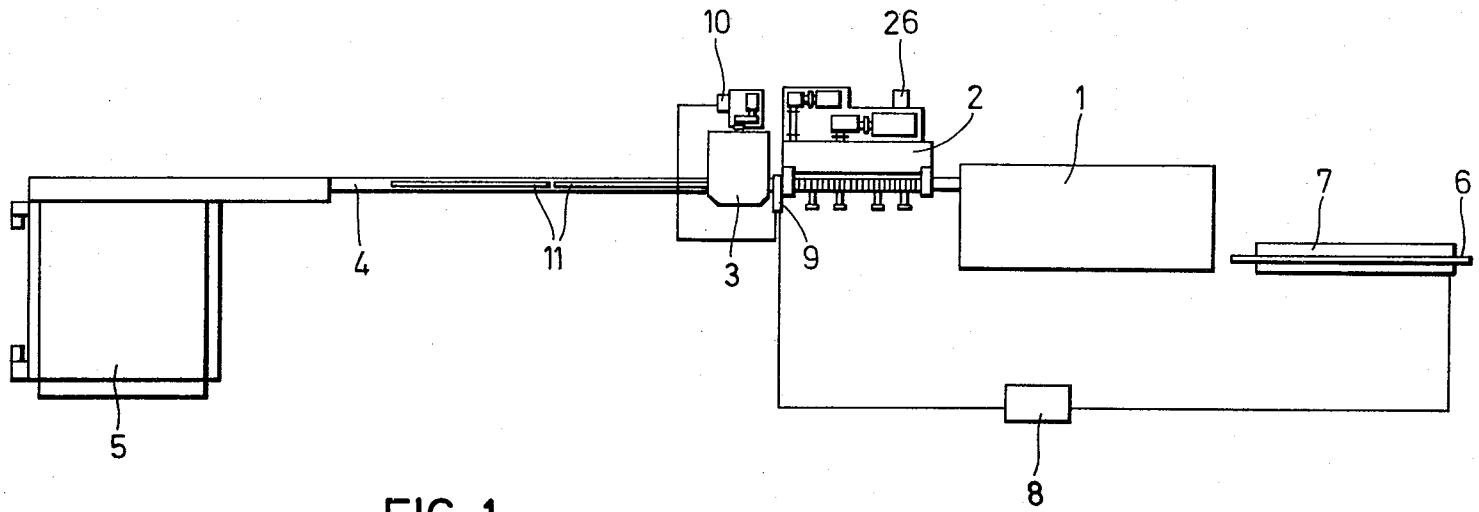

The invention relates to a stretch-reducing rolling mill for manufacturing finished tubes of reduced diameter and wall thickness from pieces of tubular stock, which rolling mill has at least one controlled severing device for cutting pieces of tube to length.

In the manufacture of tubes in the range of dimensions of up to approximately 220 mm external diameter, the principle of stretch-reducing assumes an important role as the last hot-forming step. For the purpose of manufacturing seamless tubes as well as welded tubes, the external diameter and wall thickness of tubular stock are reduced in ten to thirty two sizing passes which are disposed directly one behind the other and each of which comprises at least three rolls. In order to vary the wall thickness, longitudinal forces and tensional forces which are adjustable within wide limits between the individual sizings passes can be applied to the work-material by varying the roll speeds.

As a result of differences in the dimensions of the blooms used for producing the tubular stock, and the tolerances in the weight of the material, large differences in the lengths of the finished tubes ensue in plant for manufacturing seamless tubes and necessarily lead to residual ends or underlengths or overlengths when cutting the finished tube into pieces. These residual ends, underlengths or overlengths are either unserviceable or can only be further processed with losses. Furthermore, underlengths have to be taken into account when spacing the plant disposed downstream, such as roller beds and ejectors, and other apparatus such as cooling beds have to be designed for the overlengths. This not only increases the prime costs, but also impairs the operation of the rolling mill.

It is, in itself, possible to manufacture welded tubes in continuous operation without incurring losses due to residual ends or cropped ends. However, when manufacturing tubes of smaller diameter, the required internal deburring of the tubes renders it necessary to blow out the tubes upstream of the stretch-reducing rolling mill and this blowing-out operation renders it necessary to cut the tubular stock into short portions, since the blowing-out operation can only be performed in tubes of specific length. During this intermittent operation, residual end losses occur with each piece of tubular stock in the stretch-reducing rolling mill as a result of cutting the finished tube into pieces, in the same way as when manufacturing seamless tubes.

When manufacturing seamless tubes, attempts have already been made to determine the weight of the material of the ingot such that unsaleable residual lengths, or residual lengths which are difficult to process, do not result after the stretch-reducing operation, or the existing billet has been cut without producing residual ends, although this again leads to underlengths or overlengths. The reason for this resides in the fact that three to five hot deformation steps with very variable losses lie between the ingot and the finished tube, so that the adaptation of the weight of the ingot used is necessarily imperfect and does not lead to the desired result.

Furthermore, attempts have already been made to regulate the flying saw, used to cut the finished tube after the stretch-reducing operation, such that the length of the last pieces of finished tube from the remainder of a piece of tubular stock is changed, so that troublesome residual lengths are avoided as far as possible. However, in some cases, this results in inadmissible fluctuations in the lengths of the pieces of finished tube and leads to the disadvantages already mentioned.

When manufacturing welded tubes requiring internal deburring, it is known to cut the piece of tubular stock such that, in accordance with the theoretical dimensions such as diameter and wall thickness and the desired elongation, unsaleable residual lengths, or overlengths which are difficult to process, are avoided as far as possible. However, the pieces of finished tube cannot be adapted to the theoretical dimensions of the piece of tubular stock with sufficient accuracy to avoid underlengths or overlengths. Consequently, losses are caused by the fact that the underlengths have to be separated as scrap and thus impair output, while the overlengths require corresponding dimensions of the cooling bed and of the ejectors, which in turn renders the plant more expensive.

Based on the knowledge that it is possible to cut the finished tube so as to avoid residual ends only when a piece of tubular stock is measured, before entering the stretch-reducing rolling mill, with a degree of accuracy which renders it possible to obtain between the piece of tubular stock and the finished tube leaving the stretch-reducing rolling mill a relationship which permits the cutting of the finished tube into uniform pieces, and that this relationship is determined by the weight of the piece of tubular stock compared with the finished tube, the aim of the invention is to provide a control which, after measuring the piece of tubular stock, and taking into account the cropped end loss, the diameter and wall thickness of the finished tube and the elongation, renders it possible to cut the finished tube into pieces of equal length corresponding to the lengths required.

The present invention resides in a stretch-reducing rolling mill for manufacturing finished tubes of reduced diameter and wall thickness from pieces of tubular stock, which rolling mill has a severing device for cutting pieces of tube or stock to length, a control means for said severing device and a measuring means which is disposed in advance of the stretch-reducing rolling mill and to which the control means is connected.

When manufacturing seamless tubes, the measuring means preferably comprises a balance for weighing the piece of tubular stock, and the control means for the severing device for cutting the pieces of finished tube to length is connected to the balance by way of a computer. On the other hand, when manufacturing welded tubes, the measuring means may comprise a strip thickness measuring device disposed in advance of a tube welding apparatus which is disposed in advance of the stretch-reducing rolling mill, the strip thickness measuring device being connected to the control means for a severing device for cutting pieces of tubular stock to length. In both cases, a relationship is established between the weight of the piece of tubular stock and the finished tube. However, the weight of the piece of tubular stock is not directly determined when manufacturing welded tubes, and the volume of the piece of tubular stock is determined after measuring the strip thickness over the length of the piece of tubular stock. However, since the knowledge of the volume of the strip required for the piece of tubular stock also gives rise to knowledge of the weight, a relationship between the weight of the piece of tubular stock and the finished tube also ensues in this arrangement.

Thus, the number of pieces of finished tube is calculated from the formula:

$$n \cdot l = \frac{(d_1 - s_1) \cdot \pi \cdot s_1 \cdot L}{(d_2 - s_2) \cdot \pi \cdot s_2} - a = \frac{G/\gamma}{(d_2 - s_2) \cdot \pi \cdot s_2} - a$$

in which:

$d_1$ represents the diameter of the tubular stock,
$s_1$ represents the wall thickness of the tubular stock,
L represents the length of the tubular stock,
G represents the weight of the tubular stock,
$d_2$ represents the diameter of the finished tube,
$s_2$ represents the wall thickness of the finished tube,
l represents the length of a piece of finished tube,
n represents the number of pieces of finished tube,
a represents the cropped length (also includes further constants, such as scaling loss),
$\gamma$ represents the specific gravity of the material of the tubular stock.

Taking this formula into account, it is a simple matter, after weighing the piece of tubular stock, to split up the finished tube automatically, such that pieces of finished tube are cut to length without resulting in residual underlengths and lie within the prescribed tolerances of length. This method is used preferably when manufacturing seamless tubes. When manufacturing welded tubes, it is sufficient to determine the strip thickness of the starting material in order to calculate the length of the piece of tubular stock with the same equation when a specific length of the pieces of finished tube and the number thereof are prescribed. In this case, it is sufficient if the weight of the piece of tubular stock is an integral multiple of the weight of the piece of finished tube, taking the constants into account.

The invention can be used in a particularly advantageous manner in conjunction with a wall thickness regulating device and/or an elongation regulation device. Devices of this kind are described in German Patent Specification No. 14 27 922.

In order to be able to control, in a simple manner, the severing device for the finished tube in dependence upon the weight of the tubular stock when manufacturing seamless tubes, or the severing device for the piece of tubular stock when manufacturing welded tubes, a length measuring device is used and is connected to the severing devices.

The invention includes a method of cutting pieces of finished tube to length beyond a stretch-reducing rolling mill, in which method the piece of tubular stock is weighed and the finished tube is cut into pieces of equal length without residual lengths in dependence upon the wall thickness, the elongation and the lengths of the cropped ends. This method is used in the manufacture of seamless tubes.

When manufacturing welded tubes and cutting the pieces of tubular stock to length in advance of a stretch-reducing rolling mill, the method of the invention comprises measuring the strip thickness in advance of the tube welding apparatus and severing a piece of tubular stock beyond the tube welding apparatus, the weight of which piece of tubular stock, resulting from the strip thickness, diameter and length, is an integral multiple of the weight of a prescribed piece of finished tube, taking into account the wall thickness, elongation and loss due to scaling of the piece of finished tube.

Figure 2:
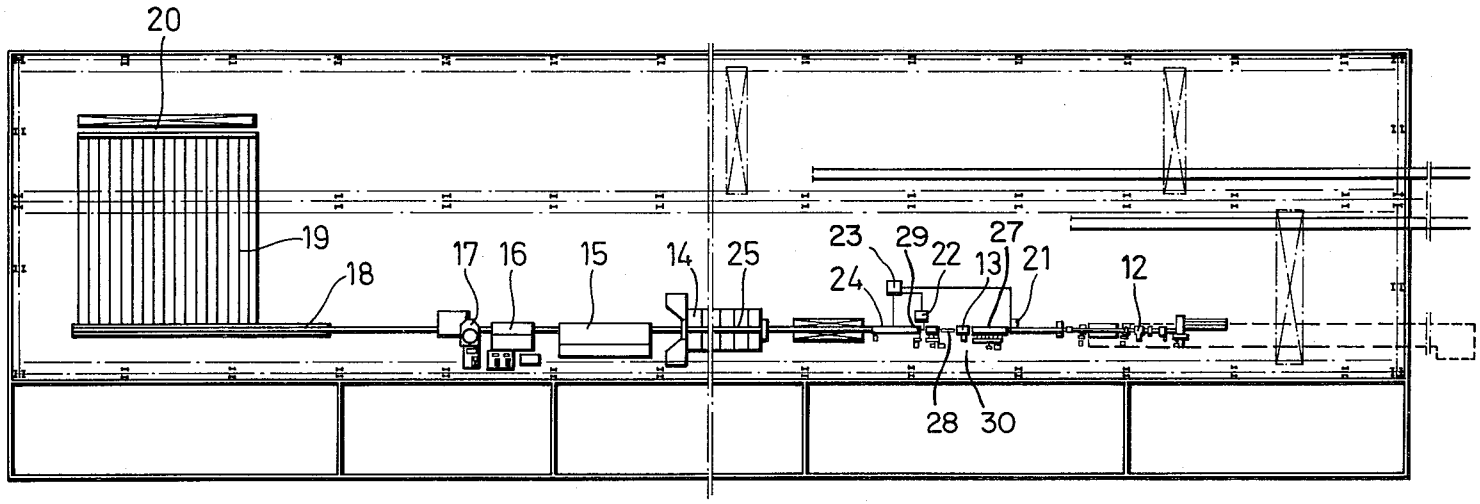

The invention will be further described hereinafter, by way of example, with reference to the drawings, in which:

FIG. 1 is a diagrammatic plan view of a stretch-reducing rolling mill, in accordance with the invention, for processing seamless pieces of tubular stock, and FIG. 2 is a diagrammatic plan view of a stretch-reducing rolling mill for processing welded tubes.

Referring to FIG. 1, the plant comprises a furnace 1 in which a seamless piece 6 of tubular stock is heated to rolling temperature. The piece 6 of tubular stock has previously been weighed by means of a balance 7. The piece 6 of tubular stock is transferred from the furnace 1 into a stretch-reducing rolling mill 2 where its diameter and wall thickness are reduced to the required dimensions. The finished tube is cut into pieces 11 of finished tube by means of a flying saw 3. The pieces 11 of finished tube pass along an ejector roller bed 4 and then into a roller cooling bed 5 from which they are conveyed for further processing. The balance 7 is connected to a control device 10 for the flying saw 3 by way of a computer 8 and a length measuring device 9 which is disposed between the stretch-reducing rolling mill 2 and the flying saw 3. The lengths of the pieces 11 of finished tube which are cut by the flying saw 3 are ascertained by the computer 8 from the weight of the piece 6 of tubular stock, the predicted loss in the furnace 1 due to scaling and the length of the cropped ends jointly being taken into account, and the cropped ends being severed independently of the pieces of finished tube. In this manner, pieces 11 of finished tube lying within prescribed tolerances can be produced in conjunction with a wall thickness regulating device 26 by means of an elongation regulating device on the stretch-reducing rolling mill 20. The flying saw is controlled such that, on the basis of the data of the balance 7 and the elongation in accordance with wall thickness regulation, the tube is cut into pieces of finished tube, so that residual lengths do not occur. The lengths of the pieces of finished tube are thereby kept within the admissible tolerances.

In the plant of FIG. 2, tubular stock is produced from a steel strip by welding. A strip preparation station 12 is disposed in advance of a tube welding apparatus 30 which comprises a strip bender 27 which curls the strip into a longitudinally slit tube, after which the longitudinal weld seam is formed by means of a welder 13. The welded seam is fitted and smoothed at the seam welder 13, immediately beyond the point of weld formation. After the tube is passed over a short roller bed 28 and through a rolling stand 29 for cooling the seam and straightening and roughly sizing the tube, it then reaches a length measuring device 22. A strip thickness measuring device 21 is located in advance of the strip bender 27 and controls a severing device 24 by way of a control device 23 in conjunction with the length measuring device 22 which is also connected to the control device. Pieces 25 of tubular stock are cut to length by means of the severing device 24 and the welded seam is fettled at the interior of the tube. The pieces 25 then pass over an intermediate grate, provided with a blow-out station 14 for removing from the tube interior swarf deposited therein as a result of the fettling and smoothing of the seam. The pieces 25 subsequently pass through an induction furnace 15 before they enter a stretch-reducing mill 16. A flying saw 17 is disposed beyond the stretch-reducing rolling mill 16 and cuts the finished tube into pieces of equal length. The pieces of finished tube are transferred to an ejector rolled bed 18 and then onto a cooling bed 19 from where they are further processed. A collector trough 20 is provided at the end of the cooling bed, into which the cooled finished tubes fall and from which they are transported away.

In this plant, the flying saw 17 always cuts pieces of finished tube to the same length, the pieces of finished tube being brought into relationship with the length of the piece 25 of tubular stock by the strip thickness measuring device 21, such that a predetermined number of pieces of finished tube is cut without residual end lengths from a piece 25 of tubular stock, taking into account the cropped ends. Here also, a relationship between the weight of the piece of tubular stock and the finished tube is produced which permits the finished tube to be cut into pieces of finished tube without residual end lengths.

I claim:

1. In a stretch-reducing rolling mill for manufacturing finished tubes of reduced diameter and substantially uniform wall thickness from pieces of tubular stock, the improvement comprising a severing device following said stretch-reducing mill receiving tubes from said mill for cutting pieces of tube or stock to substantially uniform lengths without a residual end length, a control means operatively connected to said severing device, said control means including computer means adapted to estimate a final elongated length of tubing from the weight of tubular stock entering the mill and its final wall thickness and to divide said final length into portions of substantially equal lengths, a measuring means disposed in advance of the stretch-reducing rolling mill, said measuring means including a weighing means for weighing the tubular stock prior to stretch reducing, and connections between said control means, said measuring means and said severing means whereby said severing device is actuated to cut a plurality of substantially uniform lengths of finished tubing without a residual end length in accordance with a signal from the control means.

2. A stretch-reducing mill as claimed in claim 1, for use in conjunction with tube welding apparatus which is disposed in advance of the stretch-reducing rolling mill, in which the measuring means comprises a strip thickness measuring device disposed in advance of the tube welding apparatus and connected to the control means for the severing device, which is arranged to cut the pieces of tubular stock to length.

3. A stretch-reducing rolling mill as claimed in claim 1 or 2, which also has a wall thickness regulating device and/or an elongation regulating device.

4. A stretch-reducing rolling mill as claimed in claim 1 or 3, in which a length measuring device is connected to the severing device.

* * * * *